US007625851B2

(12) United States Patent
St. Clair

(10) Patent No.: US 7,625,851 B2
(45) Date of Patent: Dec. 1, 2009

(54) VISCOSITY INDEX IMPROVER FOR LUBRICATING OILS

(75) Inventor: David John St. Clair, Houston, TX (US)

(73) Assignee: Kraton Polymers US LLC, Houston, TX (US)

( * ) Notice: Subject to any disclaimer, the term of this patent is extended or adjusted under 35 U.S.C. 154(b) by 249 days.

(21) Appl. No.: 11/715,100

(22) Filed: Mar. 7, 2007

(65) Prior Publication Data

US 2007/0213241 A1 Sep. 13, 2007

Related U.S. Application Data

(60) Provisional application No. 60/781,452, filed on Mar. 10, 2006.

(51) Int. Cl.
*C10L 1/16* (2006.01)
*C10M 169/04* (2006.01)

(52) U.S. Cl. ..... 508/591; 508/110

(58) Field of Classification Search ..... 508/591, 508/111; 585/11
See application file for complete search history.

(56) References Cited

U.S. PATENT DOCUMENTS

| | | | | |
|---|---|---|---|---|
| 3,494,942 | A | 2/1970 | Miki et al. | |
| RE27,145 | E | 6/1971 | Jones | |
| 3,634,549 | A | 1/1972 | Shaw et al. | |
| 3,670,054 | A | 6/1972 | De La Mare et al. | |
| 3,700,633 | A | 10/1972 | Wald et al. | |
| 3,772,196 | A | 11/1973 | St. Clair et al. | |
| 3,835,083 | A | 9/1974 | Tinkelenberg | |
| 3,965,019 | A * | 6/1976 | St. Clair et al. | 585/11 |
| 4,039,593 | A | 8/1977 | Kamienski et al. | |
| 4,116,917 | A | 9/1978 | Eckert | |
| 4,141,847 | A | 2/1979 | Kiovsky | |
| 4,882,384 | A | 11/1989 | Willis et al. | |
| 4,882,429 | A | 11/1989 | McCombie et al. | |
| 4,898,914 | A | 2/1990 | Gergen et al. | |
| 4,970,265 | A | 11/1990 | Willis | |
| 5,206,300 | A | 4/1993 | Chamberlain | |
| 5,276,101 | A | 1/1994 | Chamberlain et al. | |
| 5,310,490 | A * | 5/1994 | Struglinski et al. | 508/591 |
| 5,458,791 | A | 10/1995 | Rhodes et al. | |
| 5,460,739 | A | 10/1995 | Rhodes et al. | |
| 5,506,299 | A | 4/1996 | Gelles et al. | |
| 5,516,831 | A | 5/1996 | Pottick et al. | |
| 6,232,279 | B1 | 5/2001 | Steigerwald | |
| 6,492,469 | B2 | 12/2002 | Willis et al. | |
| 6,759,454 | B2 * | 7/2004 | Stephens et al. | 524/68 |
| 7,067,589 | B2 * | 6/2006 | Bening et al. | 525/280 |
| 7,141,621 | B2 * | 11/2006 | St. Clair et al. | 524/490 |
| 7,169,848 | B2 | 1/2007 | Bening et al. | |
| 7,244,785 | B2 | 7/2007 | Bening et al. | |
| 2003/0153681 | A1 * | 8/2003 | St. Clair et al. | 525/88 |

* cited by examiner

*Primary Examiner*—Glenn A Caldarola
*Assistant Examiner*—Pamela Weiss
(74) *Attorney, Agent, or Firm*—Gregory N. Clements; Donna B. Holguin

(57) ABSTRACT

A polymeric viscosity index improver that includes a hydrogenated block copolymer having at least one controlled distribution block copolymer having a minimized crystallinity is provided. An oil composition including at least a base oil and the aforementioned viscosity index improver is also provided. A polymeric concentrate including the aforementioned viscosity index improver is further provided.

8 Claims, No Drawings

VISCOSITY INDEX IMPROVER FOR LUBRICATING OILS

The present application claims priority from U.S. Provisional Patent Application No. 60/781,452, filed Mar. 10, 2006.

FIELD OF THE INVENTION

The present invention relates to a viscosity index improver (VII), an oil composition containing such a viscosity index improver and a polymeric concentrate containing such a viscosity index improver. More particularly, the present invention relates to a controlled distribution block copolymer which has minimized crystallinity that is used as a viscosity index improver, an oil composition that contains the controlled distribution block copolymer as a viscosity index improver and to a polymeric concentrate that contains the controlled distribution block copolymer as a viscosity index improver.

BACKGROUND OF THE INVENTION

The viscosity of lubricating oils varies with temperature. In general, oils are identified by a viscosity index which is a function of the oil viscosity at a given lower temperature and a given higher temperature. The given lower temperature and the given higher temperature have varied over the years, but are fixed at any given time in an ASTM test procedure (ASTM D2270). Currently, the lower temperature specified in the test is 40° C. and the higher temperature is 100° C. For two engine lubricants with the same kinematic viscosity at 100° C., the one having the lower kinematic viscosity at 40° C. will have the higher viscosity index. The oil with the higher viscosity index undergoes less kinematic viscosity change between the temperatures of 40° C. and 100° C. In general, viscosity index improvers that are added to engine oils increase the viscosity index as well as the kinematic viscosities.

The SAE Standard J300 viscosity classification system does not specify the use of viscosity index to classify multigrade oils. At one time, however, the SAE Standard did require that certain grades meet low-temperature viscosities that were extrapolated from kinematic viscosity measurements taken at higher temperatures, for it was recognized that oils that were exceedingly viscous at low-temperatures caused engine starting difficulties in cold weather. For this reason, multigrade oils which possessed high viscosity index values were favored. These oils gave the lowest low-temperature extrapolated viscosities. Since then, ASTM has developed the cold cranking simulator (CCS), ASTM D5293, (formerly ASTM D2602) a moderately high-shear-rate viscometer which correlates with engine cranking speed and starting at low temperatures. Today cranking viscosity limits, determined by the CCS, are defined in the SAE J300 Standard and viscosity index is not used. For this reason, polymers that improve the viscosity characteristics of lubricating oils are sometimes referred to as viscosity modifiers instead of viscosity index improvers.

Today, it is also recognized that cranking viscosity is not sufficient to fully estimate a lubricant's low-temperature performance in engines. SAE J300 also requires that pumping viscosity be determined in a low-shear-rate viscometer called the mini-rotary viscometer. This instrument can be used to measure viscosity and gel formation, the latter by the measurement of yield stress. In this test, an oil is slowly cooled over a two-day period to a specified temperature before viscosity and yield stress are determined. A yield stress observation constitutes an automatic failure in this test, while pumping viscosity must be below a specified limit to ensure that the oil will not cause an engine to experience a pumping failure during cold weather conditions. The test is sometimes referred to as the TP1-MRV test, ASTM D4684.

Numerous materials are used in the formulation of fully-formulated multigraded engine oils. Besides the basestocks, which may include paraffinic, napthenic, and even synthetically-derived fluids and the polymeric viscosity index improver, there are numerous lubricant additives added which act as antiwear agents, antirust agents, detergents, antioxidants, dispersants, and pour point depressants. These lubricant additives are usually combined in the oil and are generally referred to as a dispersant-inhibitor package, or as a "DI" package.

Common practice in the formulation of a multigrade oil is to blend to a target kinematic viscosity and cranking viscosity, which is determined by the specified SAE grade requirements in SAE J300. The DI package is combined with a viscosity index improver oil concentrate and with one basestock, or two or more basestocks having different viscosity characteristics. For example, for an SAE 10W-30 multigrade, the concentration of the DI package might be held constant, but the amounts of HVI 100 neutral and HVI 250 neutral or HVI 300 neutral basestock might be adjusted along with the VI improver until the target viscosities are arrived at.

Once a formulation has been arrived at that has the targeted kinematic viscosities and cranking viscosities, the TP1-MRV viscosity is determined. A relatively low pumping viscosity and the absence of yield stress are desirable. The use of a viscosity index improver which contributes little to low-temperature pumping viscosity or yield stress is very desirable in the formulation of multigrade oils. It minimizes the risk of formulating an oil that may cause an engine pumping failure and it provides the oil manufacturer with additional flexibility in the use of other components which contribute to pumping viscosity.

Viscosity index improvers that are hydrogenated star polymers containing hydrogenated polymeric arms of copolymers of conjugated dienes, including polybutadiene made by the high 1,4-addition of butadiene, were previously described in U.S. Pat. No. 4,116,917. U.S. Pat. No. 5,460,739 describes star polymers with (EP-EB-EP') arms as viscosity index improvers. Such polymers produce good thickening characteristics, but are difficult to finish. U.S. Pat. No. 5,458,791 describes star polymers with (EP-S-EP') arms as viscosity index improvers. Such polymers have excellent finishability characteristics and produce oils with good low temperature performance, but the thickening characteristics are diminished. Also, viscosity index improvers that are based on hydrogenated polybutadiene polymers typically do not work well because they are partially crystalline. The crystalline segments co-crystallize with the wax in the basestock oils linking the wax crystals together. This inhibits the ability of the pour point depressant to lower the pour point of the motor oil and the motor oils tends to become a solid at the natural pour point of the basestock, usually −18° C. to −7° C.

U.S. Pat. No. 6,034,042 provides star polymers of hydrogenated isoprene and butadiene as viscosity index improvers. While such polymers provide oil compositions with excellent low temperature properties and thickening efficiency, such polymers are more expensive to make than the hydrogenated polybutadiene polymers mentioned above.

It would be advantageous to be able to produce a polymer with good thickening characteristics and excellent finishing characteristics, yet having a lower production cost than hydrogenated isoprene and butadiene polymers. The present invention provides such a polymer.

SUMMARY OF THE INVENTION

The present invention provides a low cost solid copolymer with minimized crystallinity that is useful as a viscosity index improver in oil compositions formulated for high performance engines. The copolymer described herein can be used with a base oil to make a viscosity improved oil composition. Concentrates can also be made which will contain at least about 75% by weight of the base oil and from about 5 to about 25% by weight of the copolymer of the present invention.

Specifically, the copolymer of the present invention is a hydrogenated block copolymer including at least one controlled distribution block of a mono alkenyl arene and a conjugated diene. More specifically, the hydrogenated block copolymer employed in the present invention has at least one polymer block B and optionally at least one polymer block A wherein:

a. prior to hydrogenation each A block is a mono alkenyl arene homopolymer block and each B block is a controlled distribution copolymer block of at least one conjugated diene and at least one mono alkenyl arene;
b. subsequent to hydrogenation from about 0 to about 10% of the arene double bonds have been reduced, and at least about 90% of the conjugated diene double bonds have been reduced;
c. each A block has a number average molecular weight between about 3,000 and about 60,000 and each B block has a number average molecular weight between about 30,000 and about 300,000;
d. each B block comprises terminal regions adjacent to the A blocks that are rich in conjugated diene units and one or more regions not adjacent to the A blocks that are rich in mono alkenyl arene units;
e. the total amount of mono alkenyl arene in the hydrogenated block copolymer is about 20 percent weight to about 80 percent weight; and
f. the weight percent of mono alkenyl arene in each B block is between about 10 percent and about 75 percent, with the proviso that when no A blocks are present, then each B block comprises terminal regions that are rich in conjugated diene units and one or more non-terminal regions that are rich in mono alkenyl arene units, and with the further proviso that when more than one A block is present, then each A block has a molecular weight of less than about 5000.

The general configuration of the block copolymer employed in the present invention is $(B)_m$, A-B, A-B-A, $(A\text{-}B)_n$, $(A\text{-}B\text{-}A)_n$, $(A\text{-}B)_n\text{-}A$, $(A\text{-}B\text{-}A)_nX$, $(A\text{-}B)_nX$, $(B\text{-}A\text{-}B)_n$, $(B\text{-}A\text{-}B)_nX$ or a mixture thereof, where n is an integer from 2 to about 60, preferably from 2 to about 30, more preferably from 2 to about 15, X is a coupling agent residue which is well known to those skilled in the art, and m is an integer from 1 to about 60, preferably from 1 to about 30, and more preferably from 1 to about 15.

DETAILED DESCRIPTION OF THE INVENTION

As stated above, the present invention provides viscosity index improvers for use in oil compositions which include a hydrogenated anionic block copolymer which has minimized crystallinity. By "minimized crystallinity" it is meant that the block copolymer of the present invention has substantially no crystalline segments in the B block (i.e., the controlled distribution block) which can co-crystallize with the wax of the base oil. This is achieved in the present invention by controlling the 1,2-butadiene in the conjugated diene to a range between about 15 to about 30 mol percent and by controlling the amount and the distribution of mono alkenyl arene in the B block such that the hydrogenated 1,4-butadiene segments are too short to co-crystallize with the wax in the oil.

The oil compositions of the present invention are made using conventional procedures well known in the art. Typically, the oil compositions of the present invention are made by blending a lubricating oil with a hydrogenated block copolymer having the controlled distribution block. The blends can be made using any conventional mixing apparatus and mixing is normally done at an elevated temperature. For example, the mixing of the two essential components, together with other optional components (to be described in greater detail below), may be performed at a temperature from about 80° C. to about 175° C.

As stated above, the viscosity index improver of the present invention comprises a hydrogenated block copolymer containing at least one unique block which is a controlled distribution copolymer of a mono alkenyl arene and a conjugated diene, such as described in co-assigned U.S. Pat. No. 7,169,848 entitled "Novel Block Copolymers and Method for Making Same". The entire contents of the '981 patent, particularly the anionic polymerization method described therein, are thus incorporated herein by reference. In some embodiments, the unique block of the mono alkenyl arene and conjugated diene represents the mid block of the copolymer. In such an embodiment, the mid block is surrounded by end blocks that comprise mono alkenyl arenes. In yet other embodiments, the controlled distribution block of mono alkenyl arene and conjugated diene represents the only blocks present in the copolymer. In yet other embodiments, the controlled distribution blocks of mono alkenyl arene and conjugated diene are end blocks that surround a mono alkylene arene mid block.

Surprisingly, the combination of (1) a unique control for the monomer addition, and (2) the use of diethyl ether or other modifiers as a component of the solvent (which is referred to as a "distribution agent") results in a certain characteristic distribution of the two monomers (herein termed a "controlled distribution" polymerization, i.e., a polymerization resulting in a "controlled distribution" structure), and also results in the presence of certain mono alkenyl arene rich regions and certain conjugated diene rich regions in the polymer block.

For purposes hereof, "controlled distribution" is defined as a molecular structure having the following attributes: (1) terminal regions that can be optionally adjacent to the mono alkenyl arene homopolymer ("A") blocks that are rich in (i.e., having a greater than average amount of) conjugated diene units; (2) one or more regions not adjacent to the A blocks that are rich in (i.e., having a greater than average amount of) mono alkenyl arene units; and (3) an overall structure having relatively low mono alkenyl arene, e.g., styrene, blockiness. For the purposes hereof, "rich in" is defined as greater than the average amount, preferably 5% greater than the average amount. This relatively low mono alkenyl arene blockiness can be shown by either the presence of only a single glass transition temperature (Tg) intermediate between the Tg's of either monomer alone, when analyzed using differential scanning calorimetry ("DSC") thermal methods or via mechanical methods, or as shown via proton nuclear magnetic resonance ("H-NMR") methods. The potential for blockiness can also be inferred from measurement of the UV-visible absorbance in a wavelength range suitable for the detection of polystyryllithium end groups during the polymerization of the B block. A sharp and substantial increase in this value is indicative of a substantial increase in polystyryllithium chain ends. In such a process, this will only occur if the conjugated diene concentration drops below the critical level to maintain controlled distribution polymerization. Any mono alkylene arene monomer, such as, for example, styrene, that is present at this point will add in a blocky fashion. The term "styrene blockiness", as measured by those skilled in the art using proton NMR, is defined to be the proportion of S (i.e., styrene) units in the polymer having two S nearest neighbors on the polymer chain. Although this discussion relates to styrene blockiness, it is appreciated by those skilled in the art that the same holds for any mono alkenyl arene monomer.

The styrene blockiness is determined after using H-1 NMR to measure two experimental quantities as follows. First, the total number of styrene units (i.e., arbitrary instrument units which, when a ratio is taken, cancel out) is determined by integrating the total styrene aromatic signal in the H-1 NMR spectrum from 7.5 to 6.2 ppm and dividing this quantity by 5 to account for the 5 aromatic hydrogens on each styrene aromatic ring. Second, the blocky styrene units are determined by integrating that portion of the aromatic signal in the H-1 NMR spectrum from the signal minimum between 6.88 and 6.80 to 6.2 ppm and dividing this quantity by 2 to account for the 2 ortho hydrogens on each blocky styrene aromatic ring. The assignment of this signal to the two ortho hydrogens on the rings of those styrene units which have two styrene nearest neighbors was reported in F. A. Bovey, High Resolution NMR of Macromolecules (Academic Press, New York and London, 1972), Chapter 6.

The styrene blockiness is simply the percentage of blocky styrene to total styrene units:

Blocky %=100 times (Blocky Styrene Units/Total Styrene Units)

Expressed thus, Polymer-Bd-S—$(S)_n$—S-Bd-Polymer, where n is greater than zero is defined to be blocky styrene. For example, if n equals 8 in the example above, then the blockiness index would be 80%. It is preferred in the present invention that the blockiness index be less than about 40. For some polymers, having styrene contents of ten weight percent to forty weight percent, it is preferred that the blockiness index be less than about 10.

This controlled distribution structure is very important in minimizing the crystallinity of the resulting copolymer, because the controlled distribution structure ensures that there is virtually no phase separation of the two monomers, i.e., in contrast with block copolymers in which the monomers actually remain as separate "microphases", with distinct Tg's, but are actually chemically bonded together. This controlled distribution structure assures that only one Tg is present and that, therefore, the thermal performance of the resulting copolymer is predictable and, in fact, predeterminable. Furthermore, it is the control of the distribution of styrene throughout the copolymer block that minimizes the crystallinity that results from long sequences of 1,4-butadiene which, after hydrogenation, would crystallize.

In a preferred embodiment of the present invention, the subject controlled distribution copolymer block has two distinct types of regions—conjugated diene rich regions on the ends of the block and a mono alkenyl arene rich region near the middle or center of the block. In particular, a mono alkenyl arene/conjugated diene controlled distribution copolymer block is desired, wherein the proportion of mono alkenyl arene units increases gradually to a maximum near the middle or center of the block and then decreases gradually until the polymer block is fully polymerized. In another preferred embodiment of the present invention, the mono alkenyl arene rich regions are present at one or more non-terminal regions; the terminal regions are rich in conjugated diene in such an embodiment. It is noted that the controlled distribution block of the anionic block copolymers employed in the present invention is distinct and different from the tapered and/or random structures discussed in the prior art.

Anionic, solution copolymerization to form the controlled distribution copolymers of the present invention can be carried out using, to a great extent, known and previously employed methods and materials. In general, the copolymerization is attained anionically, using known selections of adjunct materials, including polymerization initiators, solvents, promoters, and structure modifiers, but as a key feature of the present invention, in the presence of a certain distribution agent. Such distribution agent is, in preferred embodiments, a non-chelating ether. Examples of such ether compounds are cyclic ethers such as tetrahydrofuran and tetrahydropyrane and aliphatic monoethers such as diethyl ether and dibutyl ether. In some cases, particularly where the vinyl content of the conjugated diene is to be over 50%, it may be necessary to use a chelating agent, including dialkyl ethers of ethylene glycol and aliphatic polyethers such as diethylene glycol dimethyl ether and diethylene glycol diethyl ether. Other distribution agents include, for example, orthodimethoxybenzene or "ODMB", which is sometimes referred to as a chelating agent. Preferably the ether is an aliphatic monoether, and more preferably diethyl ether. Such copolymerization can be conducted as a batch, semi-batch, or continuous preparation, with batch being most preferred, but regardless, it is important that the randomization agent be present in the selected solvent prior to or concurrent with the beginning of the copolymerization process.

The introduction of the distribution agent counteracts the preference of the growing chain end to attach to one monomer over another. For example, in the case of styrene and a diene, the preference would be toward the diene. This distribution agent operates to promote more efficient "controlled distribution" copolymerization of the two monomers because the living chain end "sees" one monomer approximately as easily as it "sees" the other. The polymerization process is thereby "tuned" to allow incorporation of each of the monomers into the polymer at nearly the same rate. Such a process results in a copolymer having no "long runs" of either of the monomer components—in other words, a controlled distribution copolymer as defined hereinabove. In the preferred process, the mono alkenyl arene monomer will be nearly consumed by the time that the slow addition of the second aliquot of diene is complete, so that the polymerization ends rich in the conjugated diene. Short blocks of the conjugated diene monomer may be formed throughout the polymerization, but blocks of the mono alkenyl arene monomer are only formed when the concentration of the conjugated diene monomer becomes quite low. Under the preferred conditions, the cumulative percentage of the mono alkenyl arene monomer in the B block peaks at about 40%-60% overall conversion, but only exceeds the final value by about 5%-30%, preferably 5-15%. The result of this relatively uniform distribution of monomers is a product having a single Tg, which is a weighted average of the Tg values of the two corresponding homopolymers.

As noted above, the distribution agent is preferably a non-chelating ether. By "non-chelating" is meant that such ethers will not chelate with the growing polymer, that is to say, they will not form a specific interaction with the chain end, which is derived from the initiator compound (e.g., lithium ion). Because the non-chelating ethers used in the present invention operate by modifying the polarity of the entire polymerization charge, they are preferably used in relatively large concentrations. Where diethyl ether, which is preferred, is selected, it is preferably at a concentration from about 0.1 to about 10 percent, preferably about 0.5 to about 10 percent, by weight of the polymerization charge (solvent and monomers), and more preferably from about 0.5 to about 6 percent by weight. Higher concentrations of this monoether can alternatively be used, but appear to increase cost without added efficacy. When the distribution agent is ODMB, the amount used is typically about 20 to about 400 parts by million weight ("PPMW"), based on the total reactor contents, preferably about 20 to about 40 PPMW for low vinyl products and about 100 to 200 PPMW for higher vinyl products.

An important aspect of the present invention is to control the microstructure or vinyl content of the conjugated diene in the controlled distribution copolymer block. The term "vinyl content" refers to the fact that a conjugated diene is polymerized via 1,2-addition (in the case of butadiene—it would be 3,4-addition in the case of isoprene). Although a pure "vinyl" group is formed only in the case of 1,2-addition polymerization of 1,3-butadiene, the effects of 3,4-addition polymerization of isoprene (and similar addition for other conjugated dienes) on the final properties of the block copolymer will be similar. The term "vinyl" refers to the presence of a pendant vinyl group on the polymer chain. The vinyl content is effectively controlled by varying the relative amount of the distribution agent. As will be appreciated, the distribution agent serves two purposes—it creates the controlled distribution of the mono alkenyl arene and conjugated diene, and also controls the microstructure of the conjugated diene. Suitable ratios of distribution agent to lithium are disclosed and taught in U.S. Pat. Re. 27,145, which disclosure is incorporated by reference.

The solvent used as the polymerization vehicle may be any hydrocarbon that does not react with the living anionic chain end of the forming polymer, is easily handled in commercial polymerization units, and offers the appropriate solubility characteristics for the product polymer. For example, non-polar aliphatic hydrocarbons, which are generally lacking in ionizable hydrogens make particularly suitable solvents. Frequently used are cyclic alkanes, such as cyclopentane, cyclohexane, cycloheptane, and cyclooctane, all of which are relatively non-polar. Other suitable solvents will be known to one skilled in the art and can be selected to perform effectively in a given set of process conditions, with temperature being one of the major factors taken into consideration.

Starting materials for preparing the controlled distribution copolymers employed in the present invention include the initial monomers. The alkenyl arene can be selected from styrene, alpha-methylstyrene, para-methylstyrene, vinyl toluene, vinylnaphthalene, and para-butyl styrene or mixtures thereof. Of these, styrene is most preferred and is commercially available, and relatively inexpensive, from a variety of manufacturers. The conjugated dienes that can be used in preparing the anionic block copolymer employed in the present invention are 1,3-butadiene and substituted butadienes, such as, for example, isoprene, piperylene, 2,3-dimethyl-1,3-butadiene, and 1-phenyl-1,3-butadiene, or mixtures thereof. Of these, 1,3-butadiene is most preferred. As used herein, "butadiene" refers specifically to "1,3-butadiene".

Other important starting materials for anionic copolymerizations include one or more polymerization initiators such as, for example, alkyl lithium compounds and other organolithium compounds such as s-butyllithium, n-butyllithium, t-butyllithium, amyllithium and the like, including di-initiators such as the di-sec-butyl lithium adduct of m-diisopropenyl benzene. Other such di-initiators are disclosed in U.S. Pat. No. 6,492,469. Of the various polymerization initiators, s-butyllithium is preferred. The initiator can be used in the polymerization mixture (including monomers and solvent) in an amount calculated on the basis of one initiator molecule per desired polymer chain. The lithium initiator process is well known and is described in, for example, U.S. Pat. Nos. 4,039,593 and Re. 27,145, which descriptions are incorporated herein by reference.

Polymerization conditions to prepare the block copolymers of the present invention are typically similar to those used for anionic polymerizations in general. Polymerization is preferably carried out at a temperature of from about −30° to about 150° C., more preferably about 10° to about 100° C., and most preferably, in view of industrial limitations, about 30° to about 90° C. It is carried out in an inert atmosphere, preferably nitrogen, and may also be accomplished under pressure within the range of from about 0.5 to about 10 bars. This copolymerization generally requires less than about 12 hours, and can be accomplished in from about 5 minutes to about 5 hours, depending upon the temperature, the concentration of the monomer components, the molecular weight of the polymer and the amount of distribution agent that is employed.

As discussed above, it is important to control of the monomer feed during the polymerization of the controlled distribution block. To minimize blockiness, it is desirable to polymerize as much of the styrene as possible in the presence of butadiene. Towards that end, a preferred process adds the styrene charge as quickly as possible, while adding the butadiene slowly, so as to maintain a concentration of no less than about 0.1% wt of butadiene for as long as possible, preferably until the styrene is nearly exhausted. If the butadiene falls below this level, there is a risk that a styrene block will form at this point. It is generally undesirable to form a styrene block during the butadiene charge portion of the reaction.

As discussed above, and in one embodiment having one or more A blocks, the controlled distribution polymer block has diene rich region(s) that are adjacent to the A block and an arene rich region not adjacent to the A block, and typically near the center of the B block. Typically, the region adjacent to the A block comprises the first 5 to 25%, preferably the first 15 to 25%, of the block and comprises the diene rich region(s), with the remainder considered to be arene rich. The term "diene rich" means that the region has a measurably higher ratio of diene to arene than the arene rich region. Another way to express this is the proportion of mono alkenyl arene units increases gradually along the polymer chain to a maximum near the middle or center of the block (assuming an ABA structure is being described) and then decreases gradually until the polymer block is fully polymerized. For the controlled distribution block B, the weight percent of mono alkenyl arene is between about 10 percent and about 75.

The present invention contemplates a variety of polymer structures and it is important to control the molecular weight of the various blocks within such polymer structures. For $(B)_m$ polymers, the preferred molecular weight range of the B polymer is from about 30,000 to about 300,000, if m=1, and from about 20,000 to about 100,000, if m is greater than 1. For an AB diblock, desired block molecular weights are from about 3,000 to about 60,000 for the mono alkenyl arene A block, and from about 30,000 to about 300,000 for the controlled distribution conjugated diene/mono alkenyl arene B block. Preferred ranges are from about 5,000 to about 45,000 for the A block and from about 50,000 to about 250,000 for the B block. For the triblock, which may be a sequential ABA or coupled $(AB)_n$ or $(ABA)_n$ block copolymer, the A blocks should be less than about 5000, preferably from about 3,000 to about 4,500, while the B block for the sequential block should be from about 30,000 to about 300,000, and the B blocks for the coupled polymers should be from about 20,000 to about 100,000. The total average molecular weight for the triblock copolymer should be from about 40,000 to about 400,000, and for the radial copolymer from about 60,000 to about 600,000 and for the star copolymer from about 100,000 to about 1,000,000. These molecular weights are most accurately determined by light scattering measurements, and are expressed as number average molecular weights.

In another embodiment of the present invention, and when butadiene is used as the conjugated diene, it is preferred that about 15 to about 30 mol percent of the condensed butadiene units in the copolymer block have 1,2 vinyl configuration as determined by proton NMR analysis. In this particular embodiment of the present invention, the aforementioned range of condensed butadiene in the copolymer block having a 1,2 vinyl configuration enables the hydrogenated block copolymer to have a maximum backbone length to maximize thickening ability in the oil, while minimizing crystallinity in the hydrogenated polymer by the presence of styrene (or another mono alkenyl arene) placed in the controlled distribution polymerization.

In yet another embodiment of the present invention, the hydrogenated block copolymer employed is a hydrogenated AB diblock polymer wherein A is polystyrene and B is EB/S, i.e., a hydrogenated polybutadiene (EB)/styrene (S) controlled distribution block. In such an embodiment, the polystyrene block (A) has a molecular weight from about 30,000 to about 50,000, with a molecular weight of about 40,000 to about 47,000 being typical, and the EB/S controlled distribution block has a molecular weight from about 60,000 to about 110,000, typically from about 80,000 to about 95,000, and a styrene content from about 30 to about 45% by weight, typically about 35 to about 40% by weight. In a particularly preferred block copolymer, the EB/S controlled distribution copolymer block typically has a molecular weight of 57,000/33,000 and is selectively hydrogenated to remove at least 90%, typically at least 95%, of the butadiene double bonds. The 1,2/1,4-butadiene ratio is from about 15/85 to about 30/70, typically about 18/82 to about 22/77. The total styrene content of the S-EB/S diblock is from about 50 to about 65, typically from about 55 to about 60, % by weight.

The hydrogenated AB diblock polymer described in the above paragraph is made utilizing the same basic procedure as described in commonly assigned U.S. Pat. No. 7,169,848 except that a low amount of distribution agent was employed. By "low amount", it is meant that the distribution agent was used in an amount of less than 1% by weight. Typically, the distribution agent is diethyl ether and the amount used in forming the aforementioned hydrogenated AB diblock polymer is about 0.5% by weight. The low level of distribution agent minimizes the 1,2-butadiene addition (to maximize the backbone length), while assuring minimum tapering during the copolymerization. In this particular diblock, the distribution of styrene is controlled throughout the EB/S block so as to help minimize crystallinity in the polymer. In addition, the diblock produced can be coupled to produce the polymer of the formula $(A\text{-}B)_n$ or $(A\text{-}B)_nX$ utilizing any of the coupling agents which are disclosed in the '981 patent.

In another embodiment of the present invention, the hydrogenated block copolymer employed is a linear, radial or star polymer having the formula $(B)_m$ wherein each B comprises terminal regions that are rich in conjugated diene units and one or more non-terminal regions that are rich in mono alkenyl arenes. In such a copolymer, m is from 1 to about 60, preferably 1 to about 30, and more preferably 1 to about 15. The total molecular weight of such a block copolymer is typically from about 30,000 to about 300,000, if m=1, and from about 20,000 to about 100,000, if m is greater than 1. Such a block copolymer is made using the basic procedure described in the '981 patent as well.

In yet a further embodiment of the present invention, the hydrogenated block copolymer is one wherein the B blocks are the end blocks which surround an A mid block. Such a block copolymer has the formula $(B\text{-}A\text{-}B)_n$ wherein n is as defined above. This block copolymer is also made utilizing the basic procedure described in the '981 patent.

The anionic block copolymer employed in the present invention is selectively hydrogenated. Hydrogenation can be carried out via any of the several hydrogenation or selective hydrogenation processes known in the prior art. For example, such hydrogenation has been accomplished using methods such as those taught in, for example, U.S. Pat. Nos. 3,494,942, 3,634,594, 3,670,054, 3,700,633 and Reexamination No. 27,145. Typically, hydrogenation is carried out under such conditions that at least about 90 percent of the conjugated diene double bonds have been reduced, and between zero and 10 percent of the arene double bonds have been reduced. Preferred ranges are at least about 95 percent of the conjugated diene double bonds reduced, and more preferably about 98 percent of the conjugated diene double bonds are reduced. Alternatively, it is possible to hydrogenate the polymer such that aromatic unsaturation is also reduced beyond the 10 percent level mentioned above. In that case, the double bonds of both the conjugated diene and arene may be reduced by 90 percent or more.

In an alternative, the block copolymer employed in the present invention may be functionalized in a number of ways. One way is by treatment with an unsaturated monomer having one or more functional groups or their derivatives, such as carboxylic acid groups and their salts, anhydrides, esters, imide groups, amide groups, and acid chlorides. The preferred monomers to be grafted onto the block copolymers are maleic anhydride, maleic acid, fumaric acid, and their derivatives. A further description of functionalizing such block copolymers can be found in U.S. Pat. Nos. 4,578,429 and 5,506,299. In another manner, the selectively hydrogenated block copolymer employed in the present invention may be functionalized by grafting silicon or boron-containing compounds to the polymer as taught, for example, in U.S. Pat. No. 4,882,384. In still another manner, the block copolymer of the present invention may be contacted with an alkoxy-silane compound to form silane-modified block copolymer. In yet another manner, the block copolymer of the present invention may be functionalized by reacting at least one ethylene oxide molecule to the polymer as taught in U.S. Pat. No. 4,898,914, or by reacting the polymer with carbon dioxide as taught in U.S. Pat. No. 4,970,265. Still further, the block copolymers of the present invention may be metallated as taught in U.S. Pat. Nos. 5,206,300 and 5,276,101, wherein the polymer is contacted with an alkali metal alkyl, such as a lithium alkyl. And still further, the block copolymers of the present invention may be functionalized by grafting sulfonic groups to the polymer as taught in U.S. Pat. No. 5,516,831.

The hydrogenated anionic block copolymers of this invention may be added to a variety of lubricating oils to improve viscosity index characteristics. For example, the inventive hydrogenated anionic block copolymers may be added to fuel oils such as middle distillate fuels, synthetic and natural lubricating oils, crude oils and industrial oils. The oils may be paraffinic, naphthenic and aromatic. The oils may be natural oils or synthetically prepared oils. In addition to engine oils, the inventive hydrogenated anionic block copolymers may be used in the formulation of automatic transmission fluids, gear lubricants, and hydraulic fluids. In general, any amount of the inventive hydrogenated anionic block copolymers may be blended into the oils, with amounts from about 0.05 to about 10 wt % being most common. For engine oils, amounts within the range from about 0.2 to about 2 wt % are preferred.

Lubricating oil compositions prepared with the inventive hydrogenated anionic block copolymers may also contain other additives such as anti-corrosive additives, antioxidants, detergents, pour point depressants, one or more additional VI improvers and the like. Typical additives which are useful in the lubricating oil composition of this invention and their description will be found in U.S. Pat. Nos. 3,772,196 and 3,835,083, the disclosure of which patents are incorporated herein by reference. The other additives are employed using ranges that are well known to those skilled in the art.

The following example is provided to illustrate the viscosity index improvers of the present invention and to demonstrate some advantages in using the same in oil compositions.

EXAMPLE

In this example, the thickening ability of a diblock copolymer of the present invention was compared to that of two conventional VII polymers. Copolymer 1 (which is representative of the present invention) was an S-EB/S diblock polymer wherein S is a polystyrene block having a molecular weight of 44,000 and EB/S represents a controlled distribution copolymer block of molecular weights 57,000/33,000 which had been selectively hydrogenated to remove at least 95% of the butadiene double bonds. The styrene content of the EB/S block of Copolymer 1 was approximately 37 weight percent (25 mole percent) and the 1,2/1,4-butadiene ratio was 21/79. The total styrene content of Copolymer 1 was 57% by weight. Copolymer 1 was made using the basic procedure outlined above. Specifically, the polymerization was performed at 50° C. in cyclohexane containing 0.5% by weight diethyl ether. Comparative Polymers 1 and 2 were S-EP type diblock polymers where S represents polystyrene and EP represents hydrogenated polyisoprene. Block molecular weights of Comparative Polymer 1 were 35,000 and 65,000, while the block molecular weights of Comparative Polymer 2 were 37,000 and 100,000 for the S and EP blocks, respectively. Comparative Polymers 1 and 2 are conventional VII polymers that are typically employed in the field of thickening oil compositions.

Each of the diblock polymers mentioned above was mixed at three concentrations into a base oil typically used for motor oils and the kinematic viscosity was measured at 100° C. The kinematic viscosity at 100° C. of the base oil was 4.2 centistokes. The results, which are shown in Table 1, show that the thickening ability of Copolymer 1 is intermediate between that of the two conventional VII polymers.

TABLE 1

Thickening Ability of Various Polymers

| Polymer | Polymer Concentration, % wt | Kinematic Viscosity at 100° C., centistokes |
|---|---|---|
| Copolymer 1 | 1.25 | 16.8 |
| Copolymer 1 | 1.50 | 23.2 |
| Copolymer 1 | 1.75 | 32.8 |
| Comparative Polymer 1 | 1.25 | 12.1 |
| Comparative Polymer 1 | 1.50 | 14.8 |
| Comparative Polymer 1 | 1.75 | 18.0 |
| Comparative Polymer 2 | 1.25 | 20.8 |

TABLE 1-continued

Thickening Ability of Various Polymers

| Polymer | Polymer Concentration, % wt | Kinematic Viscosity at 100° C., centistokes |
|---|---|---|
| Comparative Polymer 2 | 1.50 | 30.4 |
| Comparative Polymer 2 | 1.75 | 51.0 |

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the scope of the appended claims.

What is claimed is:

1. A liquid oil composition comprising:

a base oil; and a viscosity index improving amount of about 0.2 to 2.0% by weight of the composition of a hydrogenated block copolymer having at least one polymer block B and optionally at least one polymer block A, and wherein:

a. prior to hydrogenation each A block is a mono alkenyl arene homopolymer block and each B block is a controlled distribution copolymer block of at least one conjugated diene and at least one mono alkenyl arene;

b. subsequent to hydrogenation about 0-10% of the arene double bonds have been reduced, and at least about 90% of the conjugated diene double bonds have been reduced;

c. each A block has a number average molecular weight between about 3,000 and about 60,000 and each B block has a number average molecular weight between about 20,000 and about 300,000;

d. each B block comprises terminal regions adjacent to the A blocks that are rich in conjugated diene units and one or more regions not adjacent to the A blocks that are rich in mono alkenyl arene units;

e. the total amount of mono alkenyl arene in the hydrogenated block copolymer is from about 20 percent weight to about 80 percent weight; and f. the weight percent of mono alkenyl arene in each B block is between about 10 percent and about 75 percent, with the proviso that when no A blocks are present, then each B block comprises terminal regions that are rich in conjugated diene units and one or more non-terminal units that are rich in mono alkenyl arene units, and with the further proviso that when more than one A block is present, then each A block has a molecular weight of less than about 5000; and optionally one or more components selected from an anti-corrosive additive, an antioxidant, a detergent, a pour point depressant or additional VI improvers that are different from said hydrogenated anionic block copolymer.

2. The oil composition of claim 1 wherein said mono alkenyl arene is styrene, said conjugated diene is selected from the group consisting of isoprene and butadiene, and said polymer block B has mono alkenyl arene blockiness index of less than 40 mol percent.

3. The oil composition of claim 2 wherein said conjugated diene is butadiene, and wherein from about 15 to about 30 mol percent of the condensed butadiene units in block B have a 1,2-configuration.

4. The oil composition of claim 2 wherein the polymer is an ABA polymer and each block B has a center region with a minimum ratio of butadiene units to styrene units.

5. The oil composition of claim 2 wherein the weight percent of styrene in each B block is between about 10 percent and about 50 percent, and the styrene blockiness index of each block B is less than about 10 percent, said styrene blockiness index being defined to be the proportion of styrene units in the block B having two styrene neighbors on the polymer chain.

6. The oil composition of claim 1 wherein said hydrogenated block copolymer has a general configuration (B)m, A-B, A-B-A, (A-B)n, (A-B-A)n, (A-B)n-A, (A-B-A)nX, (A-B)nX, (B-A-B)n, (B-A-B)nX or a mixture thereof, where n is an integer from 2 to about 60, X is coupling agent residue, and m is an integer from 1 to about 60.

7. The oil composition of claim 6 wherein said hydrogenated block polymer has the general configuration (B)m wherein each of the B blocks comprises terminal regions that are rich in conjugated diene units and one or more non-terminal regions that are rich in mono alkenyl arene.

8. The oil composition of claim 1 wherein said hydrogenated block copolymer is a S-EB/S type polymer, wherein the S block has a molecular weight from about 30,000 to about 50,000, the EB unit of the EB/S block has a molecular weight from about 50,000 to about 65,000, the S unit of the EB/S block has a molecular weight from about 30,000 to about 40,000, the EB/S block is selectively hydrogenated to remove at least 90% of the butadiene double bonds, the styrene content of the EB/S block is from about 30 to about 40 weight percent, the 1,2/1,4-butadiene ratio is from about 15/85 to about 30/70, and the total styrene content of the S-EB/S type polymer is from about 50 to about 65.

* * * * *